US007798095B2

(12) United States Patent
Navarro

(10) Patent No.: US 7,798,095 B2
(45) Date of Patent: Sep. 21, 2010

(54) DEVICE TO HOLD DOOR FOR PAINTING

(76) Inventor: Javier E. Navarro, 3846 Cedar Ridge Rd., Indianapolis, IN (US) 46235

( * ) Notice: Subject to any disclaimer, the term of this patent is extended or adjusted under 35 U.S.C. 154(b) by 781 days.

(21) Appl. No.: 11/802,546

(22) Filed: May 23, 2007

(65) Prior Publication Data

US 2007/0272147 A1 Nov. 29, 2007

Related U.S. Application Data

(60) Provisional application No. 60/802,531, filed on May 23, 2006.

(51) Int. Cl.
*B05C 13/00* (2006.01)

(52) U.S. Cl. ..... 118/500; 118/502; 269/905; 248/157

(58) Field of Classification Search ..... 118/500, 118/502; 269/905; 248/157
See application file for complete search history.

(56) References Cited

U.S. PATENT DOCUMENTS 2,781,920 A * 2/1957 Burington ..... 414/589
5,090,648 A 2/1992 Wood, IV
D325,505 S 4/1992 Hernandez
5,164,011 A 11/1992 Ray
5,551,980 A 9/1996 Turnbo
5,627,767 A * 5/1997 Gabiniewicz et al. ..... 702/41
D418,033 S 12/1999 Svedberg
6,090,204 A 7/2000 Speed et al.
6,338,758 B1 1/2002 Curran
6,641,668 B1 11/2003 Edgerton
6,702,130 B1 3/2004 Carlilse

* cited by examiner

*Primary Examiner*—Laura Edwards
(74) *Attorney, Agent, or Firm*—Richard C. Litman

(57) ABSTRACT

The device to hold a door for painting supports a door while leaving the outer faces of the door exposed for the application of paint. The device includes a base having a securement member mounted thereon. The securement member may be selectively positioned in the longitudinal direction with respect to the base. A vertical support is releasably received by the securement member and projects upwardly therefrom. An upper horizontal support is releasably mounted to the vertical support and projects forwardly therefrom. The upper horizontal support is user-adjustable in the vertical direction, and the forward portion is received by the lock-receiving opening formed in the door. The lower edge of the door is mounted on a lower horizontal support, which is releasably secured to a forward portion of the base and extends forwardly therefrom.

18 Claims, 4 Drawing Sheets

DEVICE TO HOLD DOOR FOR PAINTING

CROSS-REFERENCE TO RELATED APPLICATION

This application claims the benefit of U.S. Provisional Patent Application Ser. No. 60/802,531, filed May 23, 2006.

BACKGROUND OF THE INVENTION

1. Field of the Invention

The present invention relates to a device for holding a door during the application of paint thereto. Particularly, an upper horizontal support and a lower horizontal support are mounted on a base, with the upper horizontal support having a forward end received by a lock-receiving opening formed in the door, and with the lower horizontal support supporting the lower edge of the door, thus maintaining the door in a substantially vertical position with all external faces exposed for the application of paint thereto.

2. Description of the Related Art

Devices for holding a door for the purposes of painting or repair typically include some sort of frame structure on which the door is seated. Typically, the frame of the device contacts the door at a minimum of points; i.e., the frame is contoured so that it contacts the door in as few points as possible to maintain the door in a vertical position while still allowing the painter access to the door. Such structures, however, still require the frame to make contact with at least a few points on the surface of the door. Thus, the door has to be moved either from the frame or within the frame in order to paint those few points.

In order to minimize the number of points of contact, some systems further provide a projection, which is received within the lock-receiving opening in the door, which ordinarily does not need to be painted. Although such systems provide substantially free access to the door for painting, the frame is typically a unitary structure, consisting of large, unwieldy parts, which do not lend themselves well to portability. Further, the size of the frame can inhibit the movement of the user, since the user must travel around the door during the painting process.

It would be preferable to provide a portable system for holding the door, which contacts the door in a minimal way, providing the user with free access to the exposed door faces. Such a system should preferably be lightweight, should not inhibit the user's access to the door, and should be portable. Thus, a device to hold a door for painting solving the aforementioned problems is desired.

SUMMARY OF THE INVENTION

The device to hold a door for painting supports a door while leaving the outer faces of the door exposed for the application of paint. The device includes a base having a securement member mounted thereon. The base may include raised rails on an upper portion thereof, with the securement member being slidably mounted on the rails, so that the securement member may be selectively positioned in the longitudinal direction with respect to the base.

A vertical support is releasably received by the securement member and projects upwardly therefrom. A lower portion of the vertical support is releasably secured by the securement member, and an upper horizontal support is releasably mounted to an upper portion of the vertical support. The upper horizontal support projects forwardly from the vertical support in the longitudinal direction. The upper horizontal support is user-adjustable in the vertical direction and the forward portion is received by the lock-receiving opening formed in the door, thus holding the door in the vertical position for painting.

The lower edge of the door is mounted on a lower horizontal support, which is releasably secured to a forward portion of the base and extends forwardly therefrom. The lower horizontal support may have a contoured upper surface, such as a saw-tooth contour, in order to more securely grip the lower edge of the door.

Following the application of paint to the door, the vertical, upper horizontal, and lower horizontal supports may be removed and transported with the base. The base may include a plurality of clips for securing the supports thereto during transportation and, further, a handle may be provided for carrying the base and supports during transport.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
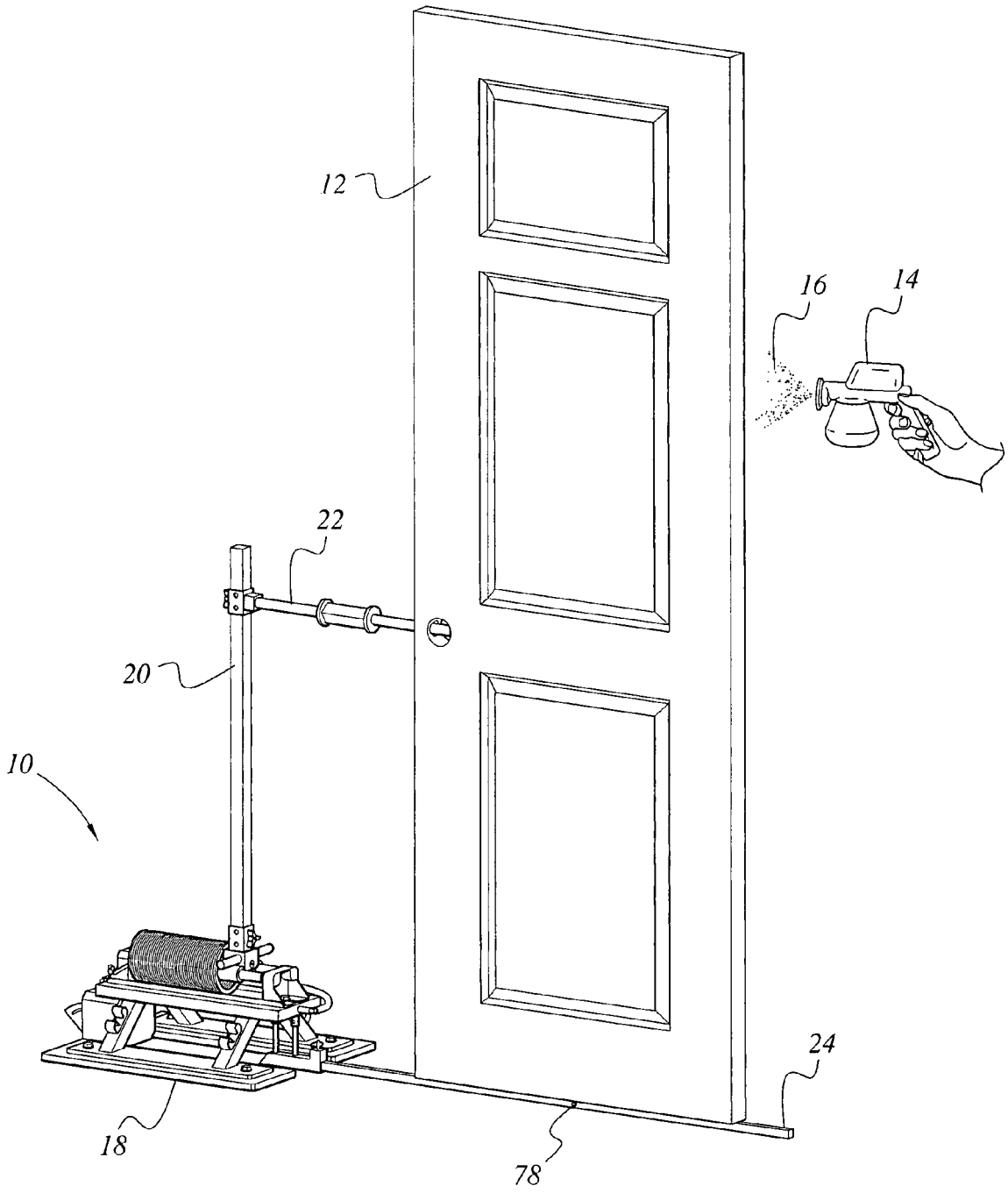
FIG. 1 is an environmental, perspective view of a device to hold a door for painting according to the present invention.

As best shown in FIG. 1, the device to hold a door for painting, designated generally as 10 in the drawings, provides a frame structure for supporting door 12 during application of paint 16. As shown, the door 12 contacts device 10 only along the lower edge of the door 12, which ordinarily would not be painted, and in the lock-receiving opening, which also is not ordinarily painted. This minimal contact between device 10 and door 12 allows the user to freely apply paint 16 without having to reposition the door 12 during application, and further does not hinder the drying process once paint 16 has been applied.

In FIG. 1, paint 16 is shown as being applied through a paint sprayer 14. It should be recognized that the user may apply paint 16 to door 12 through any desired method. However, in the preferred embodiment, device 10 is adapted for usage with a paint sprayer, such as exemplary sprayer 14. Further, although shown as a conventional household door, door 12 may be any door or other surface to which paint is to be applied.

Device 10 includes a base portion 18, which releasably supports and receives a lower horizontal support 24, a vertical support 20, such as a column or post, and an upper horizontal support 22, such as a rod, extending from vertical support 20. As will be described in greater detail below, a forward base portion 50 (shown in greater detail in FIG. 2) releasably receives and holds the lower horizontal support 24, which extends forwardly from the base portion 18, as shown. The lower horizontal support 24 supports the lower edge of door 12 and may have a contoured upper surface, such as a saw-tooth contour, in order to better hold the lower edge of the door 12.

The vertical support 20 is received within a securement member or sliding mount 40 (shown in FIG. 2), which is mounted on an upper portion of device 10. Sliding mount 40 allows the vertical support 20 to be selectively positioned in the horizontal direction, thus allowing for insertion of the free end of upper horizontal support 22 into the lock-receiving opening of door 12, and particularly through the opening formed through the door jamb edge of the door through which the door latch extends. The positionability of vertical support 20 further allows device 10 to be adapted to the holding of a variety of doors having differing contours and sizes. The column attachment end of upper horizontal support 22 is secured to the vertical support 20 through an adjustable sliding mount, allowing upper horizontal support 22 to be selectively positioned in the vertical direction. Supports 20, 22 and 24 are formed from a structurally strong material, which can support the weight of door 12, but which is preferably also lightweight and portable.

Figure 4:
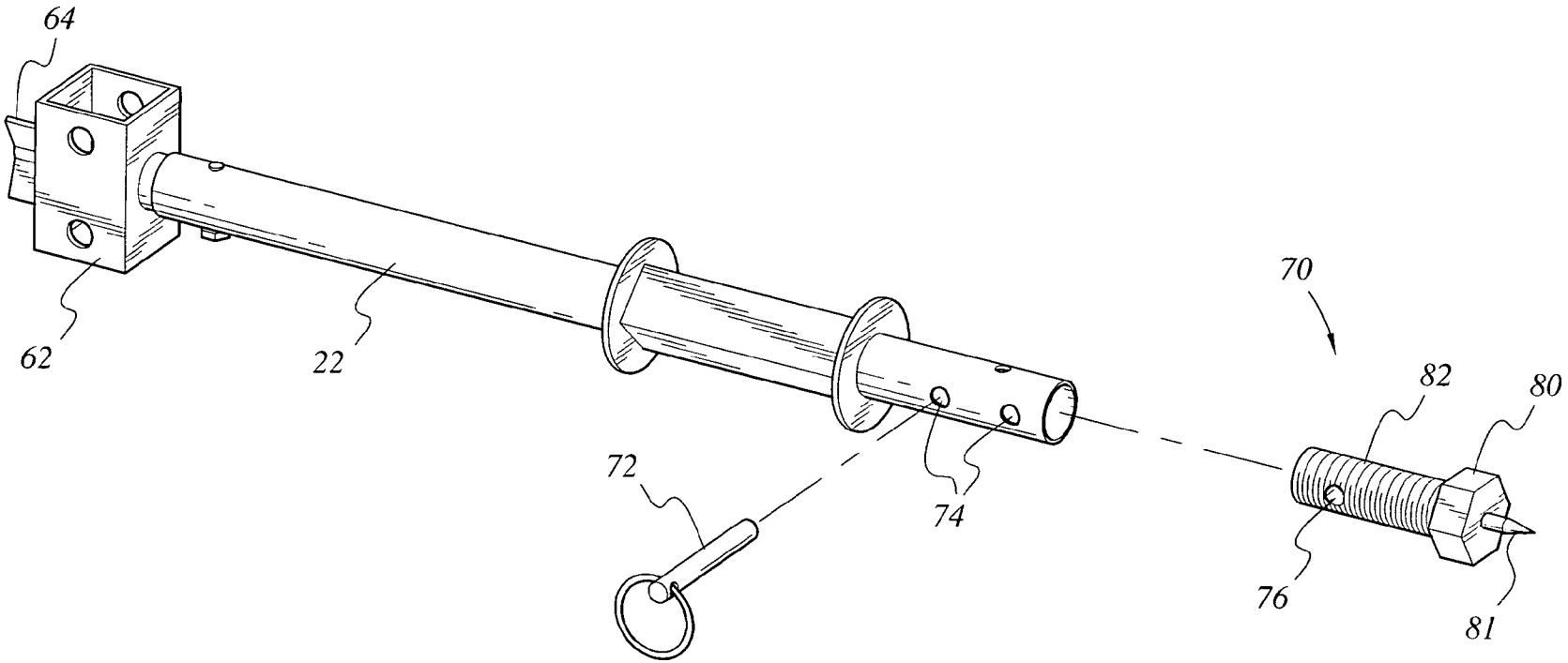
FIG. 4 is a partially exploded perspective view of an alternative embodiment of an upper horizontal support of the device to hold a door for painting according to the present invention.

As shown in FIG. 4, an extender 70 may be provided for releasable attachment to upper horizontal support 22. Upper horizontal support 22 preferably has a plurality of openings 74 formed therethrough, as shown. Extender 70 similarly has a transverse opening 76 formed through a shaft 82 thereof, with a lock pin 72 or the like being releasably received through one of openings 74 and opening 76 to releasably attach extender 70 to upper horizontal support 22. Extender 70 has a head 80, which may have any desired contour, such as having a hexagonal cross-sectional contour, allowing for use with any type of door. Multiple extenders 70 having a variety of contours and sizes may be provided. Extenders 70 may also be provided having a variety of lengths, allowing for variable length extension of the upper horizontal support 22. A spike 81 is mounted to the outer face of head 80 and projects forwardly therefrom. In use, the extender 70 may be fixed to the horizontal support for supporting a door with no opening formed therethrough, such as, for example, a sliding door or a door with a faux doorknob. The spike is inserted directly into the wood (or other material) forming the door panel in order to hold the door. The spike 81 is relatively small, thus causing minimal damage to the door by the insertion thereof.

Figure 2:
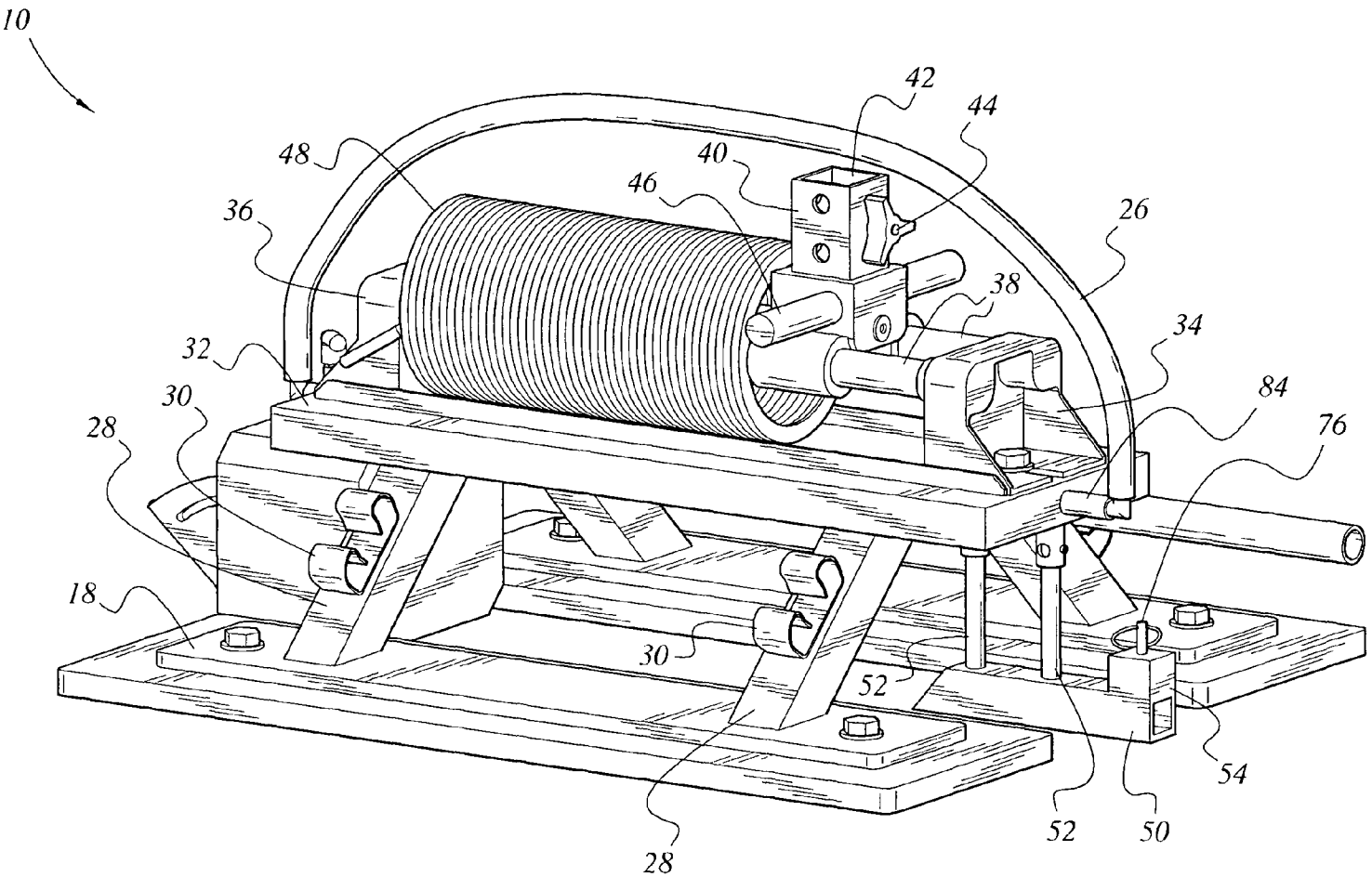
FIG. 2 is a front perspective view of the device to hold a door for painting according to the present invention.

As best shown in FIG. 2, device 10 includes base 18, which is adapted for supporting both the device 10 and the door 12 on a support surface, such as the floor or ground. Although shown as having a pair of spaced apart support plates, it should be understood that base 18 may have any suitable contour or size for stably supporting the weight of door 12.

A mounting plate 32 is supported on angled support legs 28, as shown, with the mounting plate 32 being positioned centrally with respect to the base 18. Mounting plate 32 and the other components of device 10 are positioned to distribute the weight of door 12 as evenly over base 18 as possible, thus creating a stable system and minimizing the possibility of the door tipping under its own weight.

Figure 3:
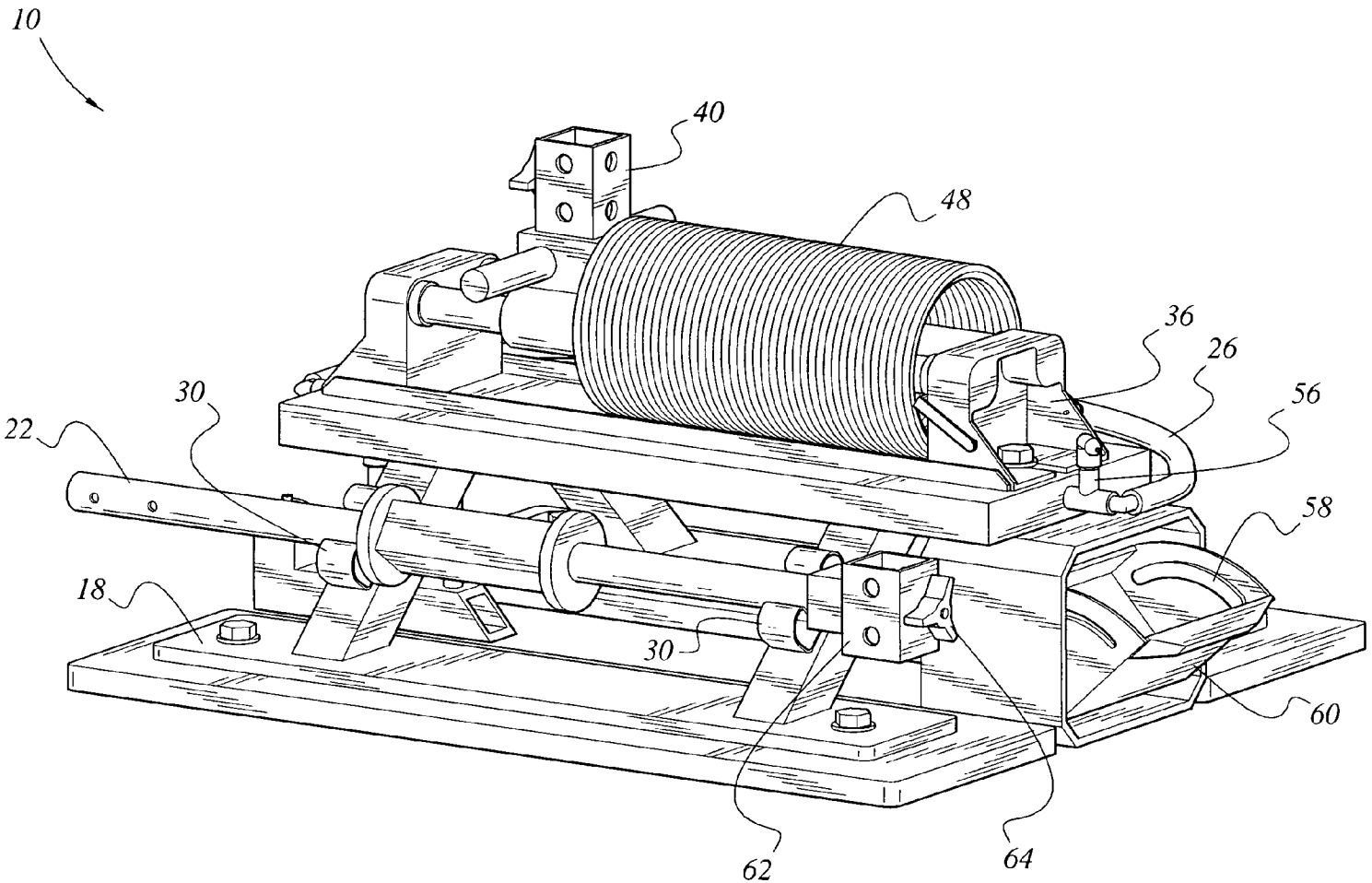
FIG. 3 is a rear perspective view of the device to hold a door for painting according to the present invention.

A clip 30 is mounted on each angled support leg 28 for receiving one of supports 20, 22 or 24 when the device 10 is not in use. As best shown in FIG. 3, the upper horizontal support 22 is releasably held by a pair of clips 30 for storage or transport. As noted above, upper horizontal support 22 has an adjustable mount 62 formed on its column attachment end, allowing for selective vertical adjustment of the upper horizontal support 22 with respect to the vertical support 20. A releasable, adjustable fastener, such as a turn screw 64, is provided for adjusting the position of the adjustable mount 62 and for clamping the mount 62 to the vertical support 20. It should be understood that clips 30 are shown for exemplary purposes only, and that any suitable means for releasable securement may be utilized.

Returning to FIG. 2, a pair of mounting rods 52 are secured to the forward portion of mounting plate 32 and project downwardly therefrom. Mounting rods 52 are secured to forward base portion 50, which supports and holds lower horizontal support 24 by a releasable connector 54, which may include spring-loaded locking pin 76 or the like. It should be understood that any suitable releasable connector may be utilized. Although shown as having a pair of downwardly extending mounting rods 52, it should be understood that forward base portion 50 may be mounted to mounting plate 32 or base 18 in any suitable manner. Alternatively, forward base portion 50 could be formed as an integral part of base 18, rather than as a separate structure, as shown. Lower horizontal support 24 preferably has a hinge 78 or other pivotal connector formed substantially centrally therein, allowing lower horizontal support 78 to be folded for transport and storage.

A front wall 34 and a rear wall 36 are mounted on mounting plate 32 and are longitudinally opposed with respect to one another. Walls 34, 36 support rails 38, which extend therebetween in the longitudinal direction. Sliding mount 40 is adjustably mounted on rails 38 in a sliding fashion, allowing for the selective horizontal adjustment in the longitudinal direction of vertical mount 20 when vertical mount 20 is received by the sliding mount 40.

As shown in FIG. 2, a cover member 48 may be provided for covering a portion of rails 38. During the application of paint 16 to door 12, stray droplets of paint may land on device 10. If these droplets were to land on rails 38, they could prevent the sliding movement of sliding mount 40 thereon. Thus, cover member 48 is provided to keep rails 38 free of clogging paint. Cover member 48 may be formed of plastic or any other suitable material, and may have any suitable size or contour.

Sliding mount 40 has an opening 42 formed in its upper end for receiving vertical support 20 therein. An adjustable fastener 44, similar to fastener 64, allows for the selective and releasable locking and adjustment of vertical mount 20 in sliding mount 40. Additionally, a pair of handlebars 46 are formed on opposed sides of sliding mount 40, and extend outwardly therefrom. Handlebars 46 provide a gripping surface for the user to longitudinally adjust sliding mount 40.

It should be noted that the pair of rails 38 provides an adjustable support in the preferred embodiment. However, any suitable adjustable mounting of vertical mount 20 may be utilized.

As further shown in FIG. 2, a handle 26 is provided, allowing the user to easily carry device 10 when not in use. Handle 26 is pivotally connected at either end to mounting plate 32, allowing the handle 26 to be rotated away from sliding mount 40 and rails 38 (as shown in FIGS. 1 and 3) when the device 10 is being used to support a door 12. Handle 26 may be formed of metal, plastic, rubber any other suitable material. Although shown as being permanently pivotally mounted, it should be understood that handle 26 may be releasably and removably mounted. The lower, horizontal rod 84, shown best in FIG. 2, is pivotally received within a passage formed through member 32. Horizontal rod 84 may be permanently rotatably mounted therein, or removably mounted therein, allowing handle 26 to be removed from device 10. Handle 26 may have any desired dimension and configuration.

As best shown in FIG. 3, a covered drawer 60 may be formed in the rear of device 10. A housing may be mounted to the bottom of mounting plate 32 at the rear of plate 32, forming an open compartment. The open compartment may be selectively closed with drawer 60, which has a cavity 58 formed therein for receiving small parts, such as screws, nuts, bolts, and the like.

When not in use, lower horizontal support 24 is disconnected from releasable connector 54, vertical support 20 is released from sliding mount 40, and upper horizontal support 22 is removed from vertical support 20. The supports 20, 22 and 24 may be held by clips 30 or carried separately. The device 10 may be transported to a different location by the user through use of the handle 26, with job-related tools and materials being carried within drawer 60.

Further, although shown as being used with a conventional door 12 having a lock-receiving opening formed therein, it should be understood that device 10 may be used to support any suitable door. An additional connector, in the form of a clamp, for example, may be mounted on the free end of horizontal support 22. A sliding door, for example, which does not have a lock-receiving opening, may have a lower edge mounted on lower support 24, as shown in FIG. 1, with the side edge being gripped or otherwise supported by the clamp. Alternatively, device 10 may be used with any suitable article requiring the application of paint, such as a shelf.

It is to be understood that the present invention is not limited to the embodiments described above, but encompasses any and all embodiments within the scope of the following claims.

I claim:

1. A device to hold a door for painting, comprising:

an elongated base having a forward portion and a longitudinally opposed rear portion;

a securement member mounted on the base, the securement member being selectively longitudinally positionable on the base;

a vertical support releasably secured to the securement member, the vertical support member extending in a substantially vertical direction; and upper and lower horizontal supports, the upper horizontal support being releasably secured to an upper portion of the vertical support and projecting forwardly therefrom in the longitudinal direction, the upper horizontal support being selectively vertically adjustable with respect to the vertical support, the lower horizontal support being releasably secured to the base and projecting forwardly therefrom in the longitudinal direction;

whereby the lower edge of a door to be painted is mountable on the lower horizontal support, the upper horizontal support being received by a lock-receiving opening formed in an edge of the door, the vertical, upper horizontal and lower horizontal supports being selectively releasable for transportation with the base.

2. The device to hold a door for painting as recited in claim 1, further comprising a handle mounted on said base for grasping by a user during transportation.

3. The device to hold a door for painting as recited in claim 2, wherein the handle is rotatably joined to said base.

4. The device to hold a door for painting as recited in claim 3, wherein the handle is releasably joined to said base.

5. The device to hold a door for painting according to claim 1, further comprising means for releasably securing said upper and lower horizontal supports to said base for use during transportation.

6. The device to hold a door for painting as recited in claim 5, wherein the means for releasably securing said upper and lower horizontal supports to said base comprise a plurality of clips mounted to said base.

7. The device to hold a door for painting as recited in claim 1, wherein said lower horizontal support includes a forward portion and a rear portion, the forward portion being adapted for supporting the lower edge of the door to be painted, the rear portion being releasably secured to the base.

8. The device to hold a door for painting as recited in claim 7, wherein the forward and rear portions of said lower horizontal support are pivotally joined to one another.

9. The device to hold a door for painting as recited in claim 1, further comprising at least one extension member releasably secured to a forward end of said upper horizontal support.

10. The device to hold a door for painting as recited in claim 9, wherein the at least one extension member comprises a shaft having a rear end, a forward end, and a head portion mounted to the forward end of the shaft, the rear end of the shaft being releasably secured to the forward end of the upper horizontal support, the head portion being adapted for insertion into the lock-receiving opening formed in the edge of the door.

11. The device to hold a door for painting as recited in claim 10, wherein the forward end of the upper horizontal support has a recess formed therein for releasably receiving the shaft of the extension member.

12. The device to hold a door for painting as recited in claim 11, wherein said upper horizontal support has at least one transverse opening formed through the forward end thereof and said extension member has a transverse bore formed through the rear end of the shaft, the device further comprising an upper locking pin releasably inserted through the transverse opening in said upper horizontal support and the transverse bore in the shaft of said extension member to releasably secure the shaft to the forward end of said upper horizontal support.

13. The device to hold a door for painting as recited in claim 12, wherein the at least one transverse opening comprises a plurality of transverse openings spaced apart along a longitudinal axis of the upper horizontal support.

14. The device to hold a door for painting as recited in claim 1, wherein the rear portion of the base has a storage compartment formed therein.

15. The device to hold a door for painting as recited in claim 14, further comprising a drawer pivotally mounted within the storage compartment.

16. The device to hold a door for painting as recited in claim 1, wherein said base has an opening formed through the forward end thereof and said lower horizontal support has a passage formed through a rear end thereof, the device further comprising a lower locking pin releasably received within the opening and the passage to releasably secure said lower horizontal support to the forward end of said base.

17. The device to hold a door for painting as recited in claim 1, further comprising at least one gripping member mounted on said securement member, the at least one gripping member being adapted for grasping by a user for selective positional adjustment of said securement member with respect to said base.

18. The device to hold a door for painting as recited in claim 1, further comprising a cover member mounted to an upper end of said base.

* * * * *